United States Patent [19]

Chan et al.

[11] Patent Number: 4,801,785

[45] Date of Patent: Jan. 31, 1989

[54] ELECTRICAL DEVICES

[75] Inventors: Chi-Ming Chan, Palo Alto; Pradeep Barma, Fremont; David Chazan, Palo Alto; David Liu, Mountain View, all of Calif.

[73] Assignee: Raychem Corporation, Menlo Park, Calif.

[21] Appl. No.: 818,844

[22] Filed: Jan. 14, 1986

[51] Int. Cl.[4] ..... H05B 3/08

[52] U.S. Cl. ..... 219/549; 219/548; 219/541; 219/553; 338/306

[58] Field of Search ..... 219/549, 548, 541, 553; 338/223, 327, 22 R, 306; 361/304, 273, 305, 433 W

[56] References Cited

U.S. PATENT DOCUMENTS

| | | | |
|---|---|---|---|
| 2,740,732 | 4/1956 | Peck et al. | 361/304 X |
| 3,861,029 | 1/1975 | Smith-Johannsen et al. | 29/611 |
| 3,973,234 | 8/1976 | Youtsey et al. | 338/306 X |
| 4,177,376 | 12/1979 | Horsma et al. | 219/553 |
| 4,190,878 | 2/1980 | Forster | 361/273 X |
| 4,223,209 | 9/1980 | Diaz | 219/549 |
| 4,237,441 | 12/1980 | Van Konynenburg et al. | 338/22 R |
| 4,305,111 | 12/1981 | Forster | 361/305 X |
| 4,315,237 | 2/1982 | Middleman et al. | 338/22 R |
| 4,324,974 | 4/1982 | Steiner et al. | 338/22 R X |
| 4,331,861 | 5/1982 | Meixner | 338/22 R X |
| 4,334,148 | 6/1982 | Kampe | 219/553 |
| 4,341,949 | 7/1982 | Steiner et al. | 219/553 |
| 4,413,301 | 11/1983 | Middleman et al. | 361/106 |
| 4,426,339 | 1/1984 | Kamath et al. | 264/22 |
| 4,426,633 | 1/1984 | Taylor | 338/22 R X |
| 4,459,473 | 1/1984 | Kamath | 264/22 |
| 4,484,252 | 11/1984 | Ruijgrov et al. | 361/433 W |
| 4,517,449 | 5/1985 | Chazan et al. | 219/549 |
| 4,543,474 | 9/1985 | Horsma et al. | 219/553 |
| 4,544,828 | 10/1985 | Shigenobu et al. | 338/327 X |
| 4,609,903 | 9/1986 | Toyokura et al. | 338/22 R X |

FOREIGN PATENT DOCUMENTS

| | | | |
|---|---|---|---|
| 2939470 | 4/1981 | Fed. Rep. of Germany | 219/541 |

*Primary Examiner*—Joseph W. Hartary
*Assistant Examiner*—M. M. Lateef
*Attorney, Agent, or Firm*—Timothy H. P. Richardson; Herbert G. Burkard

[57] ABSTRACT

Improvements to electrical devices comprising conductive polymer compositions are described. The device, preferably a heater, comprises two electrodes, preferably planar electrodes and a conductive polymer composition, which preferably exhibits PTC behavior, and which is preferably sandwiched between the electrodes. At least one of the electrodes comprises a metal with a thin layer of high resistivity material attached thereto, e.g. anodized aluminum, so that the layer separates the electrode and the conductive polymer composition. This raises the room temperature resistance of the device and thus reduces the in-rush current.

21 Claims, 2 Drawing Sheets

ELECTRICAL DEVICES

BACKGROUND OF THE INVENTION

1. Field of the Invention

This invention relates to electrical devices which comprise a conductive polymer composition.

2. Introduction to the Invention

Conductive polymer compositions and devices comprising them are known. They comprise a particulate conductive filler which is dispersed in, or otherwise held together by, an organic polymer. They can be used in circuits in which current passes through them, e.g. in heaters and circuit protection devices, and in such use they may exhibit what is known as PTC (positive temperature coefficient) or ZTC (zero temperature coefficient) behavior. The term "PTC behavior" is usually used in the art, and is so used in this specification, to denote a composition which, in the operating temperature range, has an $R_{14}$ value of at least 2.5 or an $R_{100}$ value of at least 10, preferably both, and which preferably has an $R_{30}$ value of at least 6, where $R_{14}$ is the ratio of the resistivities at the end and the beginning of the 14° C. temperature range showing the greatest increase to resistivity, $R_{100}$ is the ratio of the resistivities at the end and the beginning of the 100° C. temperature range showing the greatest increase in resistivity, and $R_{30}$ is the ratio of the resistivities at the end and the beginning of the 30° C. temperature range showing the greatest increase in resistivity. The term "ZTC behavior" is usually used in the art, and is so used in this specification, to denote a composition which does not show PTC behavior in the operating temperature range; thus the term is used to include (a) compositions which show no substantial change in resistivity over the operating temperature range (e.g. from room temperature to 100° C.), (b) compositions which show substantial increases in resistivity over the operating temperature range but still do not have $R_{14}$, $R_{30}$ or $R_{100}$ values as specified above, (c) compositions which show substantial decreases in resistivity over the operating temperature range [often denoted NTC (negative temperature coefficient) compositions], and (d) compositions as defined in (a), (b) and (c) which exhibit PTC behavior at temperatures above the operating temperature range.

Typical electrical devices comprising conductive polymer compositions comprise two electrodes, between which the conductive composition is positioned. In some known devices an intermediate member is positioned between one, or both, of the electrodes and the conductive polymer composition. Particularly relevant in this regard are U.S. Pat. No. 2,978,665 (Vernet), U.S. Pat. No. 4,177,376 (Horsma et al), U.S. Pat. No. 4,330,703 (Horsma et al) and U.S. Pat. No. 4,543,474 (Horsma et al), U.S. Pat No. 4,177,446 (Diaz et al) and U.S. Pat. No. 4,421,582 (Horsma et al), the disclosure of which are incorporated herein by reference.

The electrodes which have been used to make physical and electrical contact with conductive polymers include solid and stranded wires, metal foils, and expanded and perforated metal sheets.

A particularly useful group of devices which comprise a conductive polymer composition are those devices which exhibit so-called "PTC (positive temperature coefficient) behavior". Such devices increase in resistance as their temperature rises. When an electrical current is passed through such devices heat is generated, and the resistance of the device increases until it effectively "shuts-off" the applied current. Such devices are referred to as "self-regulating" or "self-limiting" because they automatically shut themselves off if they exceed a certain temperature. The devices find application inter alia as heater, and as circuit protection devices.

One problem associated with heaters that exhibit PTC behavior is current inrush (i.e. a much higher current passes through the device when the device is switched on than at later stages in the transition to the higher resistivity state). The high inrush current may damage the device itself and also any other components connected in the same electrical circuit as the device. Above mentioned U.S. Pat. Nos. 4,177,367, 4,330,703 and 4,543,474 inter alia alleviate the problem of high inrush currents by providing a layer of a ZTC (zero temperature coefficient) conductive polymer composition between the electrode and the conductive polymer composition.

SUMMARY OF THE INVENTION

We have found that by including a thin, highly resistive layer of an inorganic material between the electrode(s) and the conductive polymer layer, in an electrical device, it is possible (1) to reduce the in-rush currents for devices which exhibit PTC behavior and (2) to increase the overall resistance of all devices comprising conductive polymer compositions regardless of their resistivity/temperature behavior.

The devices of the invention comprise (1) a first electrode composed of a metal;
(2) a second electrode;
(3) an element which is composed of a conductive polymer and which lies between the first and second electrodes; and
(4) a resistive layer which
  (a) contacts the first electrode and lies between the first electrode and the conductive polymer element so that all electrical paths between the first electrode and conductive polymer element pass through the resistive layer,
  (b) is composed of an inorganic material having a resistivity of at least $10^5$ ohm.cm, and
  (c) is at most 12 microns thick, the first and second electrodes being connectable to a source of electrical power to cause current to pass between the electrodes through the conductive polymer element (3) and the resistive layer (4).

A preferred embodiment of the invention provides an electrical heater which comprises (1) a first laminar electrode composed of a metal;
(2) a second laminar electrode composed of a metal;
(3) a laminar element which lies between the first and second electrodes and which is composed of a conductive polymer exhibiting PTC behavior; and
(4) a laminar resistive layer which
  (a) contacts the first electrode and lies between the first electrode and the conductive polymer element so that all electrical paths between the first electrode and the conductive polymer element pass through the resistive layer,
  (b) is composed of an inorganic material which exhibits ZTC behavior and has a resistivity at 23° C. of at least $10^5$ ohm.cm, and
  (c) is at most 12 microns thick, the first and second electrodes being connectable to a source of electrical power to cause current to pass between the electrodes through the conductive polymer element and the electrodes.

BRIEF DESCRIPTION OF THE DRAWINGS

Devices according to the invention are now illustrated with reference to the drawings, wherein.

DETAILED DESCRIPTION OF THE INVENTION

Figure 1:
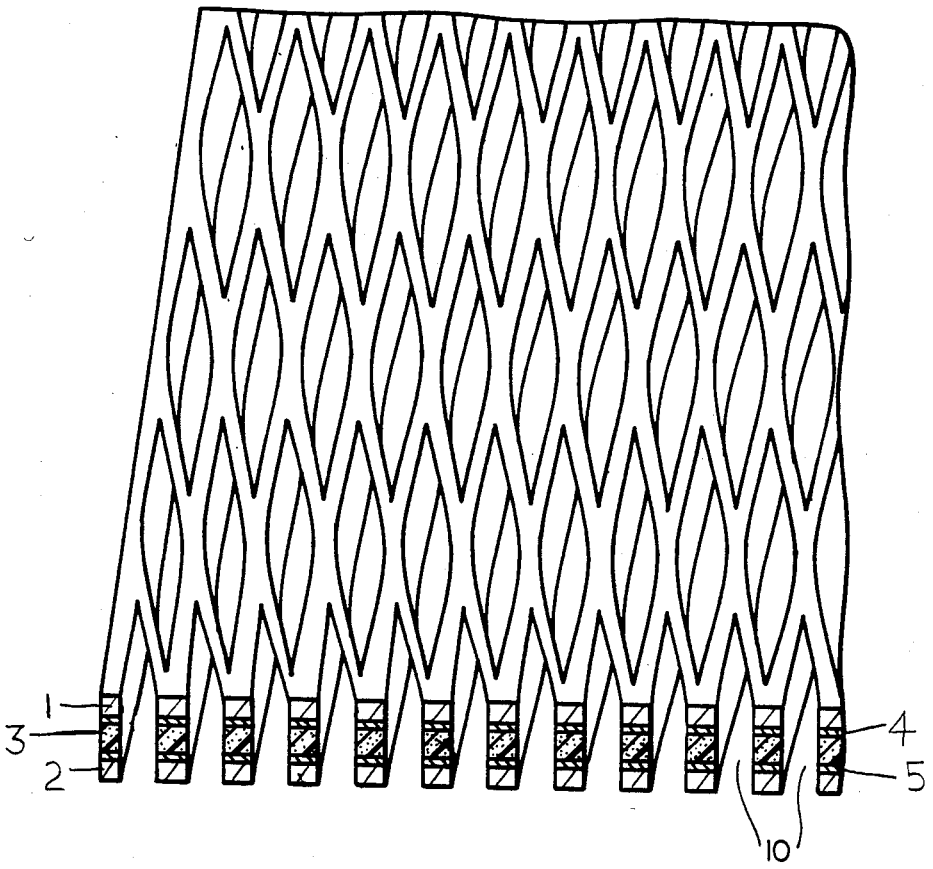
FIG. 1 shows one device according to the first aspect of the invention.

The resistive layer is preferably bonded to, or intrinsically formed on, the electrode. Where this is the case the thinness of the resistive layer is advantageous for a number of reasons. In the first place it means that the layer is very compliant. It is therefore less likely to delaminate from the adjacent bonded electrode than a thicker layer of the same material would be. Also, it is less likely to delaminate than a thicker layer when subjected to temperature changes which lead to different expansion. If a thicker layer were used, thermal cycling of the device, in use, would cause repeated expansion and contraction of the electrode and the resistive layer. Assuming the electrode and the resistive layer comprise materials having different coefficients of thermal expansion, this might eventually lead to delamination between the electrode and the resistive layer. The possibility of delamination is reduced by using a thin layer for the resistive element.

Another advantage of using a thin resistive layer is that it has a low thermal mass. This is advantageous when the device is to be used as a heater because it means that the minimum amount of heat is used to maintain the temperature of the device itself. This advantage is true regardless of whether the resistive layer is bonded to the electrode.

The resistive layer has a high resistivity of at least $10^5$ ohm.cm. By making the resistive layer from a material which has a high resistivity, a high overall resistance of the device is achieved in the direction normal to the resistive layer even though the resistive layer is thin. The high resistivity layer can conveniently be provided using an inorganic layer. The use of an inorganic material is also advantageous since inorganic materials typically have a high thermal stability. This inter alia makes it possible to use the materials in devices in which the material is subjected to high temperatures, for example in PTC devices which have a very high $T_s$ (switching temperature).

The resistive layer has a resistivity of at least $10^5$ ohm.cm and is at most 12 microns thick. Preferably the resistivity is in the range $10^5$ to $10^{14}$ ohm.cm, particularly in the range $10^6$ to $10^{12}$ ohm.cm. Preferably the layer is 0.02 to 10 microns thick, particularly 0.05 to 5 microns thick.

Where the resistive layer is bonded to the electrode, the bonding may be done in a number of ways. For example bonding may be achieved by laminating the electrode and resistive layer, or by using a deposition or coating technique. Where the resistive layer is intrinsically formed on the surface of the electrode, this may be done in a number of ways: for example by modifying the surface of the electrode. As examples of deposition and coating techniques that may be used there may be mentioned sputtering deposition, reactive sputtering, chemical and physical vapor deposition, spray pyrolysis and printing. As examples of surface modification techniques there may be mentioned anodization (using either liquid or gas electrolyte), plasma oxidation, thermal oxidation and ion nitriding. Methods involving surface modification of the electrode are particularly preferred in the present invention since they provide a strong bond between the electrode and the resistive layer. Thus the possibility of delamination between the electrode and the resistive layer is minimized. Anodization is especially preferred.

Anodization is a process which occurs at the anode for a few specific metals. The metal reacts with negative ions from the electrolyte and becomes oxidized (where the word "oxidized" is used in the broadest chemical meaning of increasing its positive charge). Anodization in acids and bases produces oxide coatings, in thiourea produces sulfide coatings, and in ammonia produces nitride coatings. Where the electrode comprises a metal which is capable of being anodized, anodization of the electrode surface is a preferred method of forming the resistive layer. Anodization in a liquid acid or base to produce an oxide coating is particularly preferred. In one preferred embodiment the electrode comprises aluminum and the resistive layer comprises aluminum oxide formed by anodization of the aluminum electrode.

Anodization is both convenient and inexpensive. Another advantage is that for most metals, the anodized metal bonds to the conductive polymer element better than the bare metal would.

Anodization and other methods which can be used to coat both major surfaces of the electrodes are particularly advantageous where the coating comprises a material that insulates or provides corrosion resistance to the underlying electrode. This is because it protects the surface of the electrode facing away from the conductive polymer, which would otherwise be exposed.

The resistive layer may comprise any suitable material. In preferred embodiments it comprises a metal oxide, nitride, carbide or sulfide, wherein the metal is the same as the metal of the first electrode. The resistive layer preferably exhibits ZTC behavior.

The conductive polymer composition may comprise any suitable material. Suitable compositions include those described in copending commonly assigned U.S. application Ser. No. 818,845 (Rosenzweig) filed contemporaneously herewith. Preferably the conductive polymer exhibits PTC behavior.

The thin, high resistivity layer has a high resistance in the direction normal to the layer. It therefore increases the overall resistance of the device in that direction. For a device in which the conductive polymer composition exhibits PTC behavior, since the initial resistance of the device in the direction normal thereto is increased, the initial in-rush currents are consequently reduced. This is particularly advantageous in heaters. For all devices according to the invention (regardless of their resistivity/temperature behavior) the initial overall resistance of the device normal thereto is increased, which is useful for many applications.

In the devices, a first resistive layer lies between the first electrode and the conductive polymer electrode. In preferred embodiments a second resistive layer is provided between the second electrode and the conductive polymer layer, so that all electrical paths between the second electrode and the conductive polymer layer pass through the second resistive layer. The above mentioned preferred features of the first resistive layer are also preferred for the second resistive layer.

Especially when the device is a heater, the electrodes are preferably in the form of a continuous metal foil. In other embodiments, each of the electrodes has a plurality of apertures in it. The heater as a whole can also have a plurality of apertures through it such that its dimensions can be changed by a change in the shape of the apertures.

The device may be any suitable size and shape. The preferred size and shape depends on the application of the device. For some applications either a strip shape or a square or rectangular shape is preferred. Where a strip is used it preferably has width of 1 to 4 inches. Where a square or rectangular shape is used, each of the side dimensions of the square or rectangle is preferably in the range 2 ft. to 6 ft.

In one application a heater is secured to a heat-recoverable polymeric article. In this case the heater can be used to effect recovery of the article. For this application the device is preferably square or rectangular in shape. Typically it is 2 ft. by 3 ft. in size and rectangular. It preferably also contains apertures to accommodate the change in the shape of the article on recovery.

In another application a device is used as a heater for objects placed in contact with the device, for example, a heater for food. The heater can be made having a low profile and light weight (for example by using aluminum electrodes). Such a heater is particularly useful for the heating of food outside of the home, since it is easily transported and stored. It can be electrically powered, for example, by a battery.

The process which is used to form or deposit the layer of inorganic material on the electrode preferably results in the inorganic material having a microrough surface to which the conductive polymer element will adhere well, particularly a surface having irregularities which protrude from the surface by a distance of at least 0.03 microns, preferably at least 0.1 microns, particularly 0.1 to 100 microns, and which have at least one dimension parallel to the surface which is at most 500 microns, preferably at most 100 microns, particularly at most 10 microns, and which is preferably at least 0.03 micron, particularly at least 0.1 micron. The irregularities can be generally spherical nodules protruding from the surface, or they can be of a different shape.

Suitable conductive polymers for use in this invention are disclosed in the documents incorporated herein by reference. Preferred conductive polymers include those based on polyolefins, particularly high density polyethylene, and those based on fluoropolymers, particularly polyvinylidene fluoride.

Reference is now made to the drawings. In all the Figures, the thickness of the devices are greatly exaggerated, for the purpose of clarification. FIG. 1 shows a heater comprising aluminum electrodes 1 and 2, and a conductive polymer layer 3, which exhibits PTC behavior. Aluminum oxide layers 4 and 5 lie between the electrodes 1 and 2, respectively, and the conductive polymer, and were formed by anodization of the aluminum. The heater contains a plurality of diamond shaped apertures 10 which pass through the thickness of the heater. The conductive polymer composition comprises polyethylene containing 43 wt % carbon black, which has been made by extrusion. The thickness of each of the layers of the device are as follows.

Figure 2:
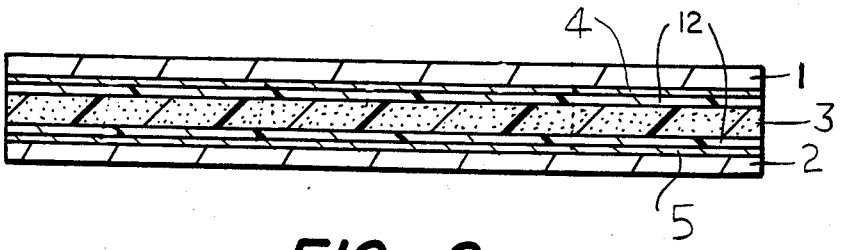
FIG. 2 shows another device according to the first aspect of the invention.

Aluminum electrode: 1 to 3 mils
oxide layer: 0.1 to 5 microns
conductive polymer layer: 20 to 60 mils The device of FIG. 1 is typically rectangular, measuring 2 ft. by 3 ft. It is suitable for use as a heater for recovering heat recoverable, for example heat shrinkable, articles. FIG. 2 shows another device according to the first aspect of the invention.

This is similar to the device of FIG. 1 except that (i) it is not apertured, (ii) the conductive polymer layer 3 is composed of a sintered material, and (iii) there is an additional layer 12 sandwiched between each of the anodized electrodes and the conductive polymer layer. Each of the additional layers 12 is a polyolefin-based ZTC layer having a thickness of 1 to 10 mils. The purpose of the layers 12 is to enhance the adhesion between the anodized electrodes and the sintered PTC layer without substantially altering the electrical resistance of the system.

The resistivities at 23° C. of each of the component parts, and for the whole, of the devices shown in FIGS. 1 and 2 are as follows:

Conductive polymer layer: 10–100 ohm.cm
aluminum layer: $10^{-6}$ ohm.cm
oxide layer: 10 million ohm.cm
ZTC layer: 10–100 ohm.cm The device of FIG. 2 is typically in the form of a strip about 2 inches wide. It is suitable for use as a plate heater, for example for food.

Figure 3:
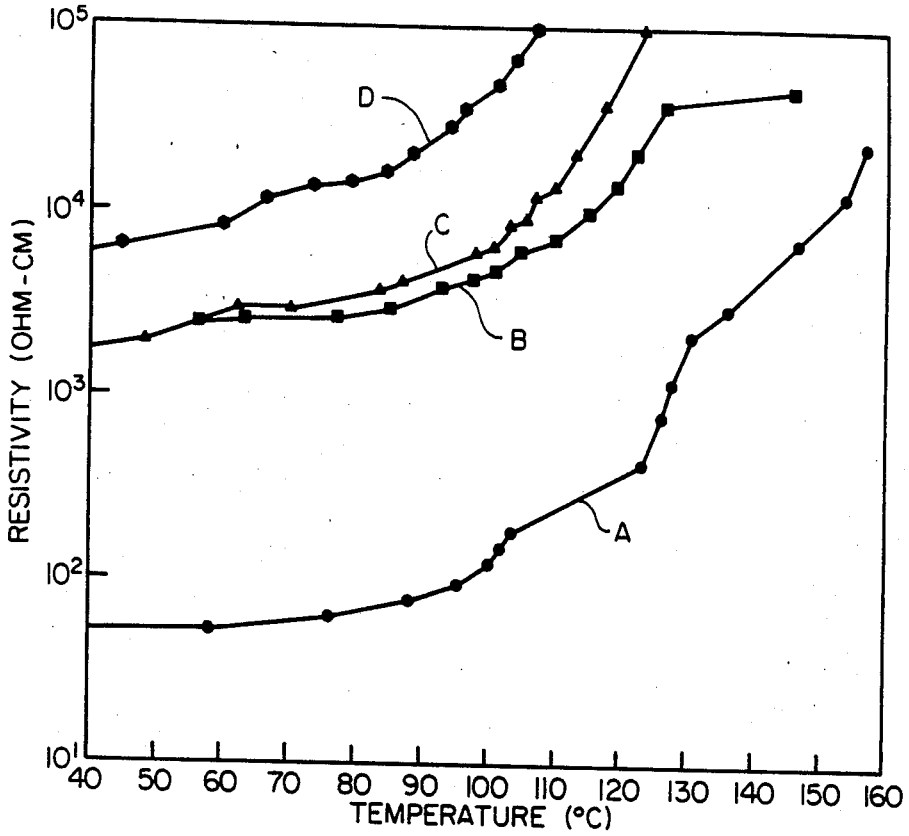
FIG. 3 is a graph showing the relationship between resistivity and temperature for devices according to the first aspect of the invention.

FIG. 3 is a graph showing the resistivity against temperature behavior for four conductive polymer heater devices. Curve A is that of a control device having the structure of FIG. 1 but without the anodized layers. Curves B and C are devices having the structure of FIG. 1, but different thicknesses of the anodized layers. Curves B, C, and D represent devices in which the thicknesses of the anodized layers are 0.5, 0.8 and 1.4 mg. per square inch respectively. All the other components in each of the devices A, B, C, and D are identical in size and composition. The resistivities are calculated from the measured resistances of the devices, ignoring the anodized layers; thus the resistivities in Curve A are indeed the resistivities of the conductive polymer, whereas the resistivities in Curves B, C and D are theoretical resistivities which would be present in a single homogeneous layer having the same resistance as the combination of the anodized and conductive polymer layers. The graphs show that the addition of the anodized layer increases the resistivity at 40° C. from below 100 ohm.cm to above 1,000 ohm.cm. The graphs also show that the size of the increase is dependent on the thickness of the resistive anodized layer.

The invention is illustrated by the following Example.

A sheet heater corresponding to that illustrated in FIG. 2 was made by the following process:

First the conductive polymer composition of layer 3 was prepared. This was done by mixing 81 wt. per cent ultra high molecular weight (GUR 412 made by Hoechst) 15 wt. per cent of a PTC compound and 4 wt. per cent of carbon black (Statex GH made by Columbian Chemicals).

The PTC compound for the conductive polymer composition of layer 3 was prepared by melt bonding 60 volume per cent high density polyethylene resin (Marlex 6003 made by Phillips) with 40 volume per cent of carbon black (Statex G made by Columbian Chemicals). The PTC compound was pulverized until at least 90 per cent of the particles were within the size range of 140 to 325 mesh. Then the PTC powder was irradiated to a dose of 6 megarads by means of a 1 MV electron beam. The irradiation cross links the PTC compound.

The conductive polymer composition was cold compacted, sintered at 200° C. for 20 minutes and then cooled under pressure. Then it was pressed at 240° C. under a pressure of 200 psi into a sheet of thickness 125 mils. Rectangular plates measuring 6 inches by 4 inches were cut from that sheet.

A plate of the conductive polymer composition was laminated between two anodized aluminum foil electrodes. Each anodized foil electrode was 2 mils thick and had an oxide layer thickness of 0.8 mg./square inch on both major surfaces thereof. Between each electrode and the conductive polymer composition an additional polyolefin layer (ref. No. 12 in FIG. 2), having a thickness of 3 mils, and exhibiting ZTC behavior was inserted. The lamination of the electrodes, ZTC layers and the plate of conductive polymer composition was carried out at 175° C. under a pressure of 2 psi.

Part of the oxide layer on the outerward facing surface of each electrode was removed and bus bars, in the form of a copper strip ⅜ inch wide and 8 inches long, attached thereto, by means of a mechanical clip.

The resistivity, at 23° C., in ohm.cm, of each of the layers of the heater was as follows.

Aluminum electrode: $10^{-6}$

Aluminum oxide layer: $10^{7}$

Intermediate ZTC layer: 100

Conductive polymer layer: 50

When the heater is connected to a 28V voltage source a current of 10A passes through the heater.

We claim:

1. An electrical device which comprises (1) a first electrode composed of a metal;

(2) a second electrode;

(3) an element which is composed of a conductive polymer; and (4) a resistive layer which (a) contacts the first electrode and lies between the first electrode and the conductive polymer element, so that all electrical paths between the first electrode and the conductive polymer element pass through the resistive layer, (b) is composed of an inorganic material having a resistivity at 23° C. of at least $10^5$ ohm.cm, (c) is at most 12 microns thick, and (d) has been formed by chemical modification of the surface of the first electrode, whereby the resistive layer comprises a metal compound wherein the metal of said compound is the same as the metal of the first electrode;

the first and second electrodes being connectable to a source of electrical power to cause current to pass between the electrodes through the conductive polymer element (3) and the resistive layer (4).

2. A device according to claim 1 wherein the inorganic material has a resistivity at 23° C. of $10^5$ to $10^{14}$ ohm.cm and the layer is 0.02 to 10 microns thick.

3. A device according to claim 1 wherein the inorganic material has a resistivity at 23° C. of $10^6$ to $10^{12}$ ohm.cm and the layer is 0.05 to 5 microns thick.

4. A device according to claim 1 wherein the resistive layer is one that was formed by anodization of the surface of the electrode.

5. A device according to claim 4 wherein the first electrode has an aluminum surface and the resistive layer is composed of an aluminum oxide formed by anodizing the surface of the electrode.

6. A device according to claim 1 wherein the metal compound is selected from oxides, nitrides, carbides and sulfides.

7. A device according to claim 1 wherein the conductive polymer exhibits PTC behavior.

8. An electrical heater which comprises (1) a first electrode composed of a metal;

(2) a second electrode composed of a metal;

(3) an element which is composed of a conductive polymer; and (4) a resistive layer which (a) contacts the first electrode and lies between the first electrode and the conductive polymer element, so that all electrical paths between the first electrode and the conductive polymer element pass through the resistive layer, (b) is composed of an inorganic material which has a resistivity at 23° C. of at least $10^5$ ohm.cm, (c) is at most 12 microns thick, and (d) comprises a metal compound wherein the metal of said compound is the same as the metal of the first electrode, the metal compound being selected from oxides, nitrides, carbides and sulfides, the first and second electrodes being connectable to a source of electrical power to cause current to pass between the electrodes through the conductive polymer element and the electrodes.

9. A heater according to claim 8 in which each of the first and second electrodes is a laminar electrode, the conductor polymer element is a laminar element, the conductive polymer exhibits PTC behavior, and the inorganic material exhibits ZTC behavior, and which further comprises (5) a second laminar resistive layer which (a) contacts the second electrode and lies between the second electrode and the conductive polymer element, so that all electrical paths between the second electrode and the conductive polymer element pass through the second resistive layer, (b) is composed of an inorganic material which exhibits ZTC behavior and has a resistivity at 23° C. of at least $10^5$ ohm.cm, (c) is at most 12 microns thick, and (d) comprises a metal compound wherein the metal is the same as the metal of the second electrode, the metal compound being selected from oxides, nitrides, carbides and sulfides.

10. A heater according to claim 9 wherein each of the electrodes is an aluminum foil which has been anodized to provide the resistive layer in contact therewith.

11. A heater according to claim 9 wherein each of the electrodes is in the form of a continuous metal foil.

12. A heater according to claim 8 wherein the heater has a plurality of apertures therethrough such that its dimensions can be changed by a change in the shape of the apertures.

13. A heater according to claim 12 which is secured to a heat-recoverable polymeric article.

14. An electrical device which comprises (1) a first electrode composed of a metal;

(2) a second electrode;

(3) an element which is composed of a conductive polymer; and (4) a resistive layer which (a) contacts the first electrode and lies between the first electrode and the conductive polymer element, so that all electrical paths between the first electrode and the conductive polymer element pass through the resistive layer, (b) is composed of an inorganic material having a resistivity at 23° C. of at least $10^5$ ohm.cm, (c) is at most 12 microns thick, and (d) has been formed on the first electrode by a technique selected from sputtering deposition, reactive sputtering, chemical and physical vapor deposition, spray pyrolysis and printing;

the first and second electrodes being connectable to a source of electrical power to cause current to pass between the electrodes through the conductive polymer element (3) and the resistive layer (4).

15. A device according to claim 14 wherein the inorganic material has a resistivity of $10^5$ to $10^{14}$ ohm.cm and the layer is 0.02 to 10 microns thick.

16. A device according to claim 14 wherein the inorganic material has a resistivity of $10^6$ to $10^{12}$ ohm.cm and the layer is 0.05 to 5 microns thick.

17. A device according to claim 14 wherein the resistive layer comprises a metal oxide wherein the metal of said oxide is the same as the metal of the first electrode.

18. A device according to claim 14 wherein the resistive layer comprises a metal compound wherein the metal of said compound is the same as the metal of the first electrode, the metal compound being selected from oxides, nitrides, carbides and sulfides.

19. A device according to claim 14 wherein the conductive polymer exhibits PTC behavior.

20. A device according to claim 14 wherein the second electrode is composed of a metal and which further comprises (5) a second laminar resistive layer which (a) contacts the second electrode and lies between the second electrode and the conductive polymer element, so that all electrical paths between the second electrode and the conductive polymer element pass through the second resistive layer (b) is composed of an inorganic material which exhibits ZTC behavior and has a resistivity at 23° C. of at least $10^5$ ohm.cm, (c) is at most 12 microns thick, and (d) has been formed on the second electrode by a technique selected from sputtering deposition, reactive sputtering, chemical and physical vapor deposition, spray pyrolysis and printing.

21. A device according to claim 14 wherein each of the electrodes is in the form of a continuous metal foil.

* * * * *